US011185142B1

(12) United States Patent
Potter et al.

(10) Patent No.: US 11,185,142 B1
(45) Date of Patent: Nov. 30, 2021

(54) HAIR DRYER ATTACHMENT

(71) Applicant: SharkNinja Operating LLC, Needham, MA (US)

(72) Inventors: James Richard Potter, Windsor (GB); Joshua Thomas Richards, Hassocks (GB); Steven Luke Bailey, Greater London (GB)

(73) Assignee: Sharkninja Operating LLC, Needham, MA (US)

( * ) Notice: Subject to any disclaimer, the term of this patent is extended or adjusted under 35 U.S.C. 154(b) by 0 days.

(21) Appl. No.: 17/139,700

(22) Filed: Dec. 31, 2020

(51) Int. Cl.
*A45D 20/12* (2006.01)

(52) U.S. Cl.
CPC ..... *A45D 20/124* (2013.01)

(58) Field of Classification Search
CPC .... A45D 20/124; A45D 20/122; A45D 20/12; A45D 20/26
USPC ..... 34/96, 283
See application file for complete search history.

(56) References Cited

U.S. PATENT DOCUMENTS

| | | | | |
|---|---|---|---|---|
| 5,060,398 | A * | 10/1991 | Wolens | A45D 20/122 34/90 |
| 9,936,789 | B2 | 4/2018 | Stephens et al. | |
| 10,575,617 | B2 | 3/2020 | Courtney et al. | |
| 2016/0367003 | A1 | 12/2016 | Stephens et al. | |
| 2016/0367008 | A1 | 12/2016 | Stephens et al. | |
| 2017/0006991 | A1 | 1/2017 | Stephens et al. | |
| 2017/0079401 | A1* | 3/2017 | Courtney | A45D 20/124 |
| 2017/0273425 | A1 | 9/2017 | Stephens et al. | |
| 2019/0098979 | A1 | 4/2019 | Atkinson et al. | |
| 2019/0216199 | A1 | 7/2019 | Shelton et al. | |

FOREIGN PATENT DOCUMENTS

| | | | |
|---|---|---|---|
| AU | 2013285200 | A1 | 1/2015 |
| EP | 3310207 | A1 | 4/2018 |
| EP | 3461364 | A1 | 4/2019 |
| GB | 2424831 | A | 10/2006 |
| GB | 2515809 | B | 8/2015 |
| GB | 2515811 | B | 11/2015 |
| GB | 2531431 | A | 4/2016 |
| GB | 2539431 | A | 12/2016 |
| GB | 2539438 | A | 12/2016 |
| GB | 2539440 | A | 12/2016 |
| GB | 2539441 | A | 12/2016 |
| GB | 2548617 | A | 9/2017 |
| GB | 2566976 | A | 4/2019 |
| GB | 2566977 | A | 4/2019 |
| GB | 2576017 | A | 2/2020 |
| WO | 2016203197 | A1 | 12/2016 |
| WO | 2019239090 | A1 | 12/2019 |
| WO | 2020165554 | A1 | 8/2020 |

* cited by examiner

*Primary Examiner* — John P McCormack
(74) *Attorney, Agent, or Firm* — Mintz Levin Cohn Ferris Glovsky and Popeo, PC; Lisa Adams

(57) ABSTRACT

An attachment for a hair dryer that is movable between a first position and a second position in order to alter one or more characteristics of the airflow therethrough. In one embodiment, an internal sliding element is movable within an outer housing in order to alter the internal flow paths inside the housing. In a second embodiment, movable arms cause changes to the shape of an outer housing made of a flexible and resilient material. Motion of the arms between positions causes a change in the shape of the attachment outlet.

12 Claims, 5 Drawing Sheets

HAIR DRYER ATTACHMENT

FIELD OF THE INVENTION

The present invention relates to hair dryers in general and attachments for hair dryers in particular.

BACKGROUND

Hair dryers are well known in the art to provide a flow of air that a user can utilize to dry wet hair. In many instances, the hair dryer also heats and/or ionizes the air prior to the air exiting the hair dryer. Hair dryers generally include an outlet that includes an opening with fixed dimensions where the heated air is expelled from the device. It is known in the art that altering one or more aspects (e.g., speed, direction, type of airflow, etc.) of the airflow emerging from the outlet by providing a removable attachment can, at times, be desirable.

The disclosed embodiments of the present invention improve on the shortcomings of the prior art hair dryer attachments that are currently known.

SUMMARY

According to one embodiment of the present invention, an attachment for a hair dryer includes an outer housing having an attachment inlet at a first end and an attachment outlet at a second end, and a sliding element that is movable inside the outer housing between a first position and a second position. The sliding element includes a rear surface, a front surface and an opening that extends therethrough from the rear surface to the front surface. The rear surface of the sliding element is closer to the attachment inlet at times the sliding element is in the first position than at times the sliding element is in the second position. The front surface of the sliding element is closer to the attachment outlet at times the sliding element is in the second position than at times the sliding element is in the first position.

According to a second embodiment of the present invention, an attachment for a hair dryer includes an inner frame, a first arm, a second arm, a base, and an outer housing. The inner frame defines an opening therethrough. A first arm is coupled to the inner frame and movable between a first position and a second position. A second arm is coupled to the inner frame and movable between a first position and a second position. The outer housing has a first end coupled to the inner frame, and a second end includes an attachment outlet. The base defines an attachment inlet. The attachment outlet has a first shape at times the first and second arms are in the first position. The attachment outlet has a second shape at times the first and second arms are in the second position.

One advantage of the present invention is the ability for the user to couple a hair dryer attachment to a hair dryer in order to change one or more characteristics of the airflow of the hairdryer.

Another advantage of the present invention is the ability for the user to alter the hair dryer attachment by moving a movable part in order to alter the manner in which the attachment affects the airflow of the hair dryer while using a single attachment.

These and other benefits will be apparent to one of skill in the art in light of the included figures and detailed description.

DETAILED DESCRIPTION OF THE INVENTION

Figure 1:
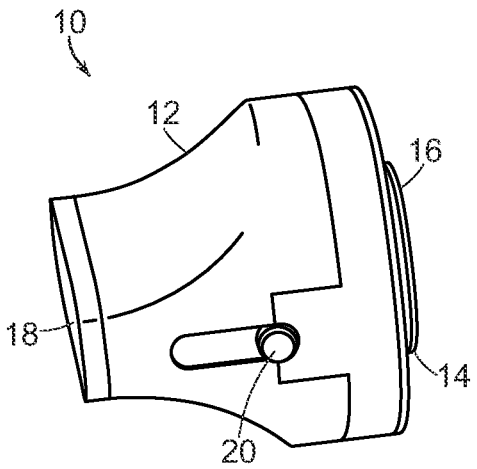
FIG. 1 is a first embodiment of the hair dryer attachment of the present invention.
Figure 2:
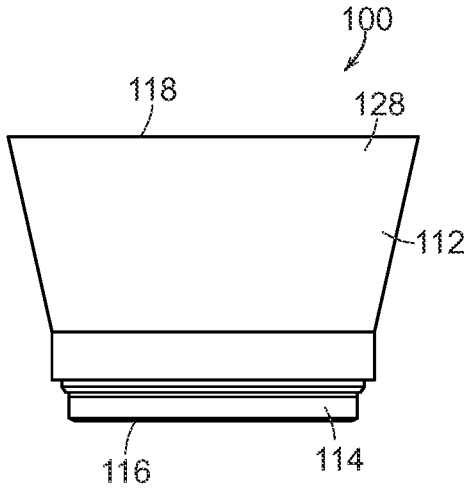
FIG. 2 is a second embodiment of the hair dryer attachment of the present invention in the concentrator position.

Referring to FIG. 1, a first embodiment of the hair dryer attachment 10 is shown. The hair dryer attachment 10 includes an outer frame 12, a base 14, an attachment inlet 16, and attachment outlet 18 and a slide lever 20. Referring to FIG. 2, a second embodiment of the hair dryer attachment 100 is shown. The hair dryer attachment 100 includes a flexible outer housing 112, a base 114, an attachment inlet 116, and attachment outlet 118.

Figure 3:
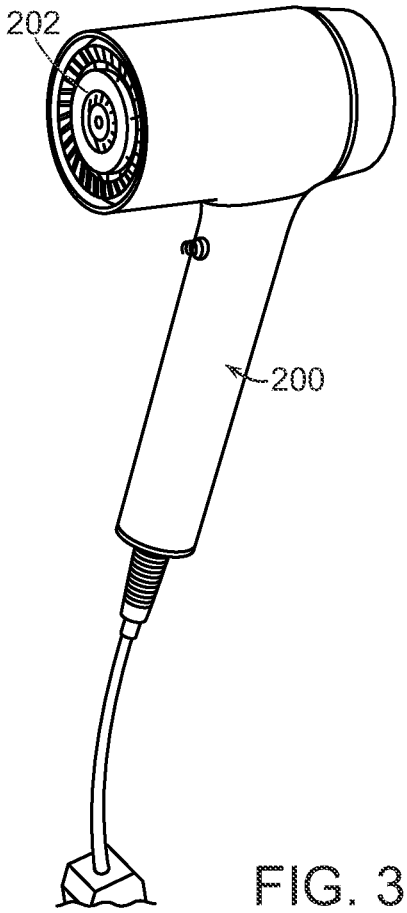
FIG. 3 is an isometric view of a typical hair dryer.

Both embodiments of the hair dryer attachments 10, 100 are removably attachable to the hair dryer 200 shown in FIG. 3. The attachment between the hair dryer 200 and the hair dryer attachment 10, 100 can be achieved, in both embodiments, by any acceptable means. For instance, the hair dryer attachments 10, 100 can be press fit onto the hair dryer 200, the hair dryer attachments 10, 100 and hair dryer 200 can include complementary connectors, and/or the hair dryer attachments 10, 100 can be attached using a magnetic connection. In some embodiments, once attached, the hair dryer attachment 10, 100 can rotate relative to the hair dryer 200 while attached; however, in other preferred embodiments, the hair dryer attachment 10, 100 is not rotatable relative to the hair dryer 200 once attached. When attached, the attachment inlet 12, 112 of the hair dryer attachment 10, 100 is in fluid communication with the hair dryer outlet 202.

Figure 4A:
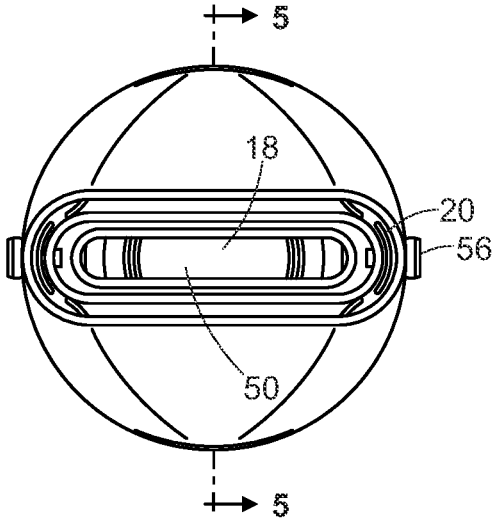
FIG. 4A is a front view of the hair dryer attachment of FIG. 1.
Figure 4B:
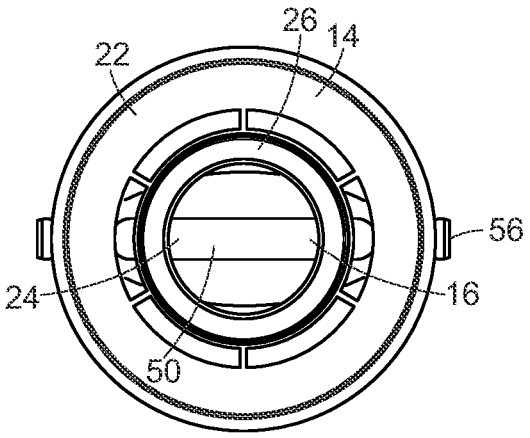
FIG. 4B is a rear view of the hair dryer attachment of FIG. 1.

Referring now to FIGS. 4A-B, the front and rear of the first embodiment of the hair dryer attachment 10 are shown. The front view (FIG. 4A) depicts the shape of the outer frame 12 and includes the attachment outlet 18. In the embodiment shown, the attachment outlet 18 is oval in shape with a smaller cross-sectional area than the attachment inlet 16; however, the present invention is not so limited, and the attachment outlet 18 can have any suitable cross-sectional shape desired. The rear view of the embodiment shown in FIG. 4B depicts the base 14 of the hair dryer attachment 10 and includes the hair dryer engagement surface 22 surrounding the attachment inlet 16. The hair dryer engagement surface 22 is preferably complementary to the surface at the hair dryer outlet 202 for the specific hair dryer 200 with which the hair dryer attachment 10 is intended to be used. The attachment inlet 16 can include one or more openings 24. For example, in instances where the hair dryer 200 includes more than one hair dryer outlet 202, it may be desirable to include separate attachment inlets 16 to align with specific hair dryer outlets 202. Alternatively, the attachment inlet 16 can include inner walls 26 that generally direct the air expelled from the hair dryer 200 and into the hair dryer attachment to flow in pre-determined direction(s) and/or change the type of airflow.

Figure 4C:
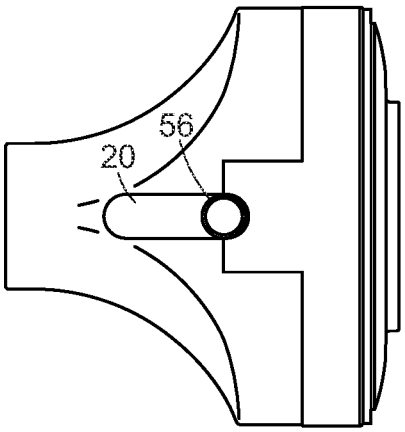
FIG. 4C is a side view of the hair dryer attachment of FIG. 1.
Figure 4D:
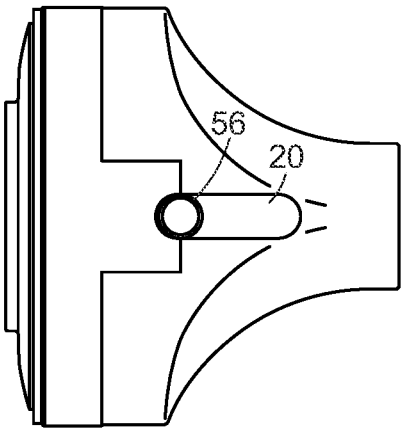
FIG. 4D is another side view of the hair dryer attachment of FIG. 1.

Referring now to FIGS. 4C-D, the right and left sides of the hair dryer attachment 10 are shown. A lever is shown extending through the outer frame 12 that is movable between a first position and a second position.

Figure 5:
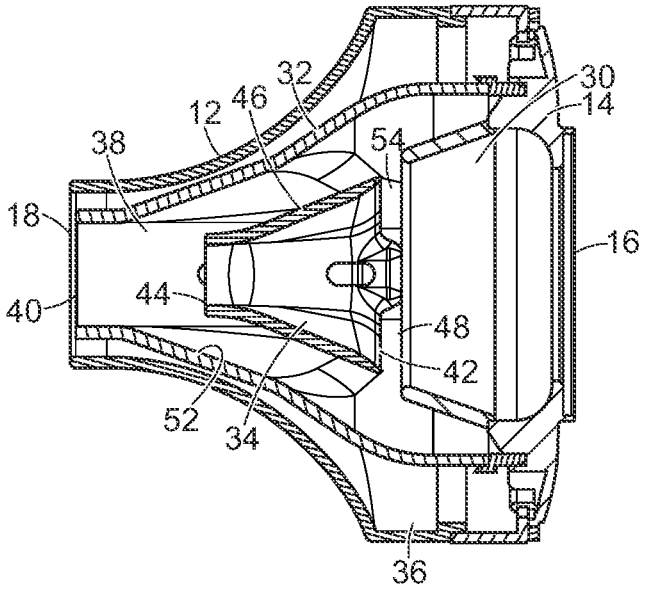
FIG. 5 is a cross-sectional view along line 5-5 of the hair dryer attachment of FIG. 4A.

Referring now to FIG. 5, a cross-sectional view along line 5-5 of FIG. 4A is shown, revealing the internal portion of the hair dryer attachment 10. The hair dryer attachment 10 includes the base 14 connected to a first chamber 30, the outer frame 12, an inner frame 32, and a sliding element 34.

The outer frame 12 defines an interior volume 36. Preferably, the outer frame 12 includes a larger cross-sectional area towards the attachment inlet 16, and a smaller cross-section area at the attachment outlet 18. The outer frame 12 is coupled to the base 14 and, at an opposite end, defines the attachment outlet 18. The inner frame 32 is positioned inside the outer frame interior volume 36 and is also coupled to the base 14. The inner frame 32 defines an inner frame interior volume 38 and extends from the base 14 to a position at or near the attachment outlet 18. The inner frame 32 defines an inner frame outlet 40 that is, preferably, approximately co-planar with the attachment outlet 18.

In some embodiments, the inner frame 32 includes one or more openings that permit airflow from the inner frame interior volume 38 to a volume located outside the inner frame 32 but inside the outer frame interior volume 36 such that at least some air flows through the hair dryer attachment 10 outside the inner frame 32. In other embodiments, the inner frame 32 does not include such openings, and substantially all of the air entering through the attachment inlet 16 flows through the inner frame 32 to the inner frame outlet 40.

Continuing to refer to FIG. 5, the base is coupled to a first chamber 30 located adjacent the attachment inlet 16 such that air entering through the attachment inlet 16 flows into the first chamber 30 and then out the first chamber outlet 48 before entering into the inner frame interior volume 38.

Figure 6A:
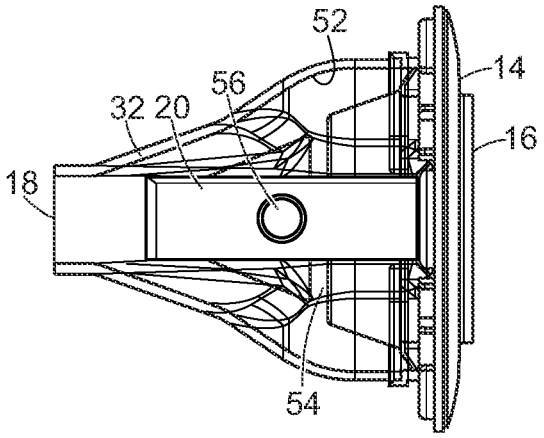
FIG. 6A is an alternative view of the hair dryer attachment of FIG. 4C with the outer cover removed and the lever in the first position.
Figure 6B:
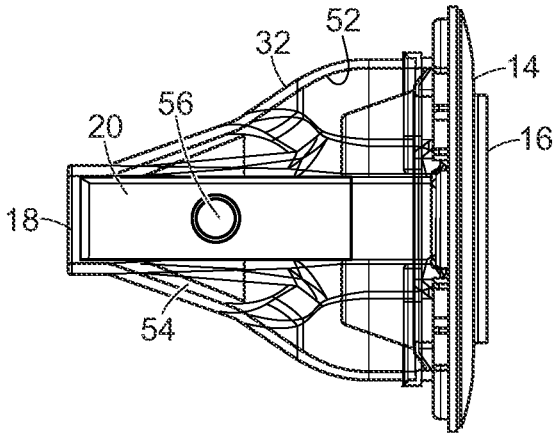
FIG. 6B is the hair dryer attachment of FIG. 6A with the lever in the second position.
Figure 7:
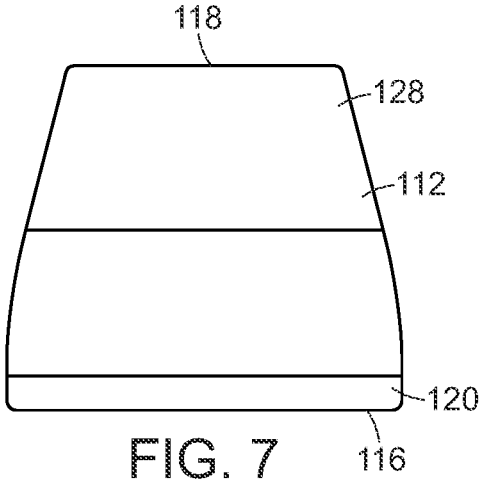
FIG. 7 is a side view of the second embodiment of the hair dryer attachment shown in FIG. 2 in the smoother position.

Referring now to FIGS. 5, 6A and 6B, a sliding element 34 is slidably positioned inside the inner frame such that it is movable between a first position (FIG. 6A) and a second position (FIG. 6B). The sliding element 43, as shown in FIG. 5 includes a rear surface 42, a front surface 44, and at least one outer wall 46. The rear surface 42 is similar in size and shape to the first chamber outlet 48.

Referring back to FIGS. 4A and 4B, the sliding element 34 includes a central opening 50 through which air is permitted to flow; however, in some embodiments, the sliding element 34 can lack such a central opening 50 and air must flow around the sliding element 34 inside the inner frame 32.

Referring to FIGS. 5 and 6A, the rear surface 42 is in close proximity to the first chamber outlet 48 when the sliding element 34 is in the first position such that, in embodiments where the central opening 50 is present, the central opening 50 is in fluid communication with the inner frame outlet 40. The front surface 44 of the sliding element 34 is located in a central portion of the inner frame 32 and spaced away from the attachment outlet 18 when in the first position (FIG. 6A).

In the embodiment shown, the outer wall(s) 46 of the sliding element 34 taper from the rear surface 42 to the front surface 44 such that the outer wall(s) 46 are generally complementary to the inner wall(s) 52 of the inner frame 32 when the sliding element 34 is in the second position (FIG. 6B). The front surface 44 of the sliding element 34 is preferably located at or near the attachment outlet 18 when in the second position (FIG. 6B).

Referring to FIGS. 6A and 6B, a gap 54 exists between the sliding element 34 and the inner walls 52 of the inner frame 32 such that at least some airflow extends around the sliding element 34 inside the inner frame 32 at all times, regardless of whether the sliding element 34 is in the first position, the second position, or somewhere therebetween.

Continuing to refer to FIGS. 6A and 6B, the sliding element 34 is coupled to at least one slide lever 20. In the embodiment shown, the slide lever is slidably coupled to the exterior of the inner frame 32. A user accessible pin 56 attached to the slide lever 20 extends through the outer frame 12, enabling a user to move the sliding element 34 between the first and second positions.

In operation, the user removably attaches the hair dryer attachment 10 to the hair dryer 200 such that the hair dryer engagement surface 22 is positioned around the hair dryer outlet. The user turns on the hair dryer 200 so that heated air is expelled from the hair dryer outlet 202 and into the hair dryer attachment 10 through the attachment inlet 16. The airflow then passes through the first chamber and exits the first chamber outlet 48 before entering the inner frame 32.

The user optionally manually moves the user accessible pin 56 connected to the slide lever 20 to the first position (FIG. 6A). The motion of the slide lever 20 causes the sliding element 34 to move to the first position such that the rear surface 42 comes into close proximity with the first chamber outlet 48. In this position, the front surface 44 is moved inward into the inner frame 32 and away from the attachment outlet 18. Some of the air exiting the first chamber outlet 48 flows into the central opening 50 while the remainder of the air flows through the gap 54 between the sliding element 34 and the inner frame 32. The two separate airflows flow past the sliding element 32 and rejoin at or near the front surface of the sliding element inside the inner frame between being expelled from the hair dryer attachment.

The user optionally manually moves the user accessible pin 56 connected to the slide lever 20 to the second position (FIG. 6B). The motion of the slide lever causes the sliding element 34 to move to the second position such that the rear surface 42 is spaced away from the first chamber outlet 48. In this position, the front surface 44 is moved to a position at or near the attachment outlet 18. Air exiting the first chamber outlet 48 flows into and travels through a portion of the inner frame 32 before encountering the sliding element 34. Some of the airflow then flows into the central opening 50 of the sliding element 34 while the remainder of the air flows through the gap 54 between the sliding element 34 and the inner frame 32 shown in FIG. 6B. The two separate airflows flow past the sliding element 32 and either exit the hair dryer attachment 10 separately or rejoin at or near the inner frame outlet 48.

The user may also optionally manually move the user accessible pin 56 connected to the slide lever 20 to any position between the first and second positions to achieve different types of airflow.

Referring now to FIGS. 2, 7, 8A and 8B, a second embodiment of the hair dryer attachment 100 is shown. The hair dryer attachment 100 includes an outer housing 112, a base 114, an attachment inlet 116 and an attachment outlet 118. The hair dryer attachment 100 is transformable by the user between a concentrator (FIG. 8A) where the attachment outlet 118 is generally an oval shape, and a smoother (FIG. 8B) where the attachment outlet 118 is generally circular in shape.

The outer housing 112 is made of a flexible material that has the ability to change shape. For example, suitable materials include silicon, acrylics, rubber and the like that are flexible, resilient, and also stable when exposed to temperatures typically present at or near the outlet 202 of a typical hair dryer 200. A first end 120 of the outer housing 112 is coupled to an inner frame 122. In the embodiment shown, the first end 120 of the outer housing 112 has a generally round cross-sectional shape.

Figure 9A:
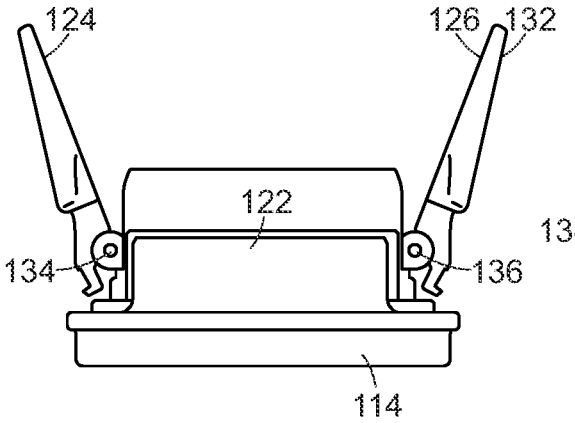
FIG. 9A is an alternative view of the hair dryer attachment of FIG. 2 with the outer cover removed and position arms in the concentrator position.
Figure 9B:
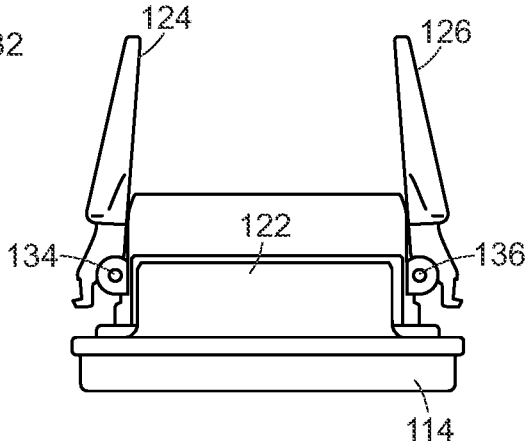
FIG. 9B is an alternative view of the hair dryer attachment of FIG. 7 with the outer cover removed and position arms in the smoother position.

Referring to FIGS. 9A and 9B, the inner frame 122 includes a first arm 124 and a second arm 126 that are pivotally connected to the inner frame 122 such that the first and second arms 124, 126 are movable between a first position (FIG. 9A) and a second position (FIG. 9B). In the first position, the first and second arms 124, 126 generally extend upwards and away from the inner frame 122. In the second position, the first and second arms 124, 126 generally extend upwards.

Referring back to FIGS. 2 and 7, a second end 128 of the outer housing 112 extends to a position at or near the ends of the first and second arms 124, 126, and includes an opening 130 that forms the attachment outlet 118. When the arms 124, 126 are moved to the first position, the arms 124, 126 press against the inside of the flexible outer housing 112 material and tend to stretch the material, particularly in the region near the second end 128. The stretching of the outer housing 112 material tends to stretch the opening 130 into the general oval shape shown in FIG. 8A. Preferably, the outer surface 132 of the arms 124, 126 are contoured to urge the ends of the oval into the desired shaped. When the arms 124, 126 are moved to the second position, the arms 124, 126 release from the inside of the flexible outer housing 112 material and the resilient outer housing 112 material tends to return to the relaxed (or near relaxed) position at the second end 128. The release of the stretching of the outer housing 112 when moved to the second position from the first position tends to permit the opening 130 of the resilient material of the outer housing 112 to return to a generally round shape, as shown in FIG. 8B.

The inner frame 122 is rotatably coupled to a base 114 between a first position (FIG. 9A) and a second position (FIG. 9B). A coupling mechanism (not shown) translates rotational motion of the inner frame 122 relative to the base 114 into rotational motion of the first and second arms 124, 126 relative to the inner frame 122 about a first axis 134 and a second axis 136, respectively. When the inner frame 122 is in a first position, the ends of the arms 124, 126 are rotated outwards (FIG. 6A) to convert the opening 130 in the flexible outer housing 112 material to an oval shape. When the inner frame 122 is rotated to a second position, the ends of the arms 124, 126 are rotated inwards (FIG. 6B) and permit the opening 130 of the resilient outer housing 112 material to return to a generally round shape.

Figure 10A:
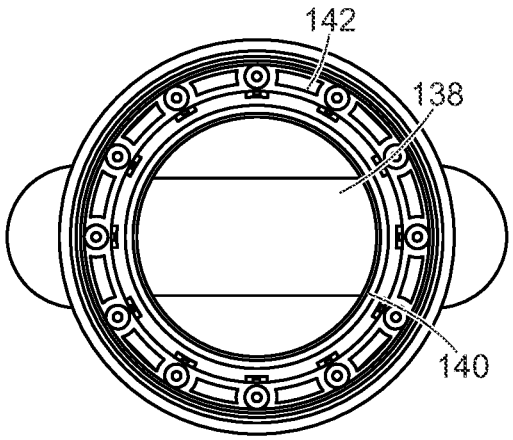
FIG. 10A is a rear view of the hair dryer attachment of FIG. 2 in the concentrator position.
Figure 10B:
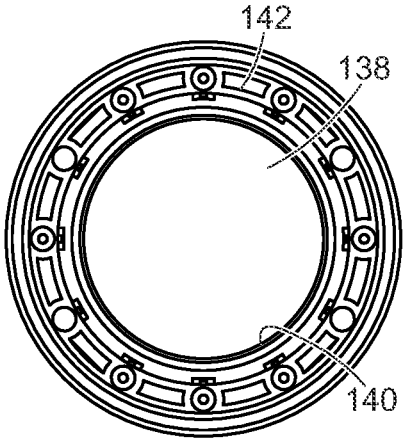
FIG. 10B is a rear view of the hair dryer attachment of FIG. 7 in the smoother position.

Referring to FIGS. 10A and 10B, the inner frame 122 includes an opening 138 therethrough that permits the passage of airflow.

Continuing to refer to FIGS. 10A and 10B, the rear view of the hair dryer attachment 100 in both the concentrator position (FIG. 10A) and the smoother position (FIG. 10B) are shown. The base 114 includes an opening 140 that forms the attachment inlet 116. Although a single opening 140 is shown, the hair dryer attachment 100 can include one or more openings 140. For example, in instances where the hair dryer 200 includes more than one hair dryer outlet 202, it may be desirable to include separate attachment inlets 116 to align with specific hair dryer outlets 202. Alternatively, the attachment inlet 116 can include inner walls (not shown) that generally direct the air expelled from the hair dryer 200 and into the hair dryer attachment to flow in pre-determined direction(s) and/or change the type of airflow. The base 14 of the hair dryer attachment 10 includes a hair dryer engagement surface 142 surrounding the attachment inlet 16. The hair dryer engagement surface 142 is preferably complementary to the surface at the hair dryer outlet 202 for the specific hair dryer 200 with which the hair dryer attachment 10 is intended to be used.

In operation, the user removably attaches the hair dryer attachment 100 to the hair dryer 200 such that the hair dryer engagement surface 22 is positioned around the hair dryer outlet 202. The user turns on the hair dryer 200 so that heated air is expelled from the hair dryer outlet 202 and into the hair dryer attachment 100 through the attachment inlet 116.

The airflow then passes through the base 114 and the opening 138 in the inner frame 32 before exiting through the attachment outlet 118 at the second end 128 of the outer housing 112.

Figure 8A:
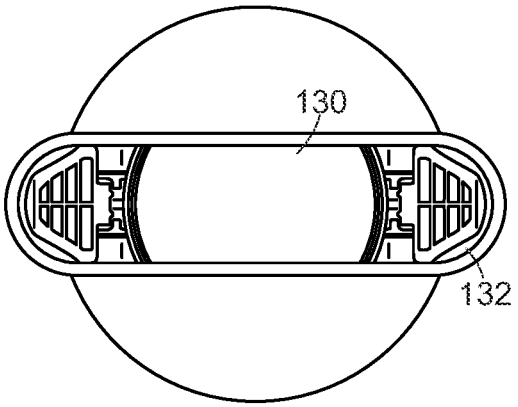
FIG. 8A is a front view of the hair dryer attachment of FIG. 2 in the concentrator position.
Figure 8B:
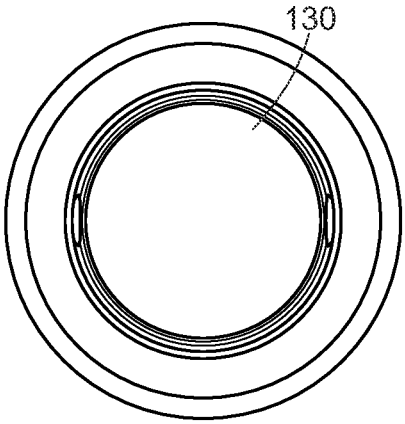
FIG. 8B is a front view of the hair dryer attachment of FIG. 7 in the smoother position.

The user optionally manually rotates the outer housing 112 and inner frame 122 relative to the base towards the first position (FIG. 8A). The relative motion of the inner frame 122 relative to the base 114 causes the first and second arms 124, 126 to rotate about the first and second axes 134, 136, respectively, causing the ends of the arms 124, 126 to rotate away from one another. The re-positioning of the ends of the arms 124, 126 causes the second end of the flexible outer housing 112 material to stretch and change shape such that the opening 130 takes on a generally oval shape. The airflow expelled from the hair dryer attachment 100 in this position is generally concentrated due to the narrower and elongated cross-sectional area of the opening 130.

The user optionally manually rotates the outer housing 112 and inner frame 122 relative to the base towards the second position (FIG. 8B). The relative motion of the inner frame relative to the base causes the first and second arms 124, 126 to rotate about the first and second axes 134, 136, respectively, causing the ends of the arms 124, 126 to rotate towards one another. The re-positioning of the ends of the arms 124, 126 causes the second end of the resilient outer housing 112 material to relax and change shape such that the opening 130 takes on a generally round shape. The airflow expelled from the hair dryer attachment 100 in this position is generally smoothed due to the increased and rounded cross-sectional area of the opening 130.

The user may also optionally manually rotate the outer housing 112 and inner frame 122 relative to the base to a position between the first position and the second position in order to achieve different types of airflow.

One of skill in the art would know that additional embodiments, or variations to the above description can be made without departing from the spirit or scope of the invention.

We claim:

1. An attachment for a hair dryer, comprising:

a housing that defines an attachment inlet at a first end and an attachment outlet at a second end;

a sliding element receivable within the housing and movable between a first position and a second position, the sliding element having a rear surface and a front surface and an opening that extends therethrough from the rear surface to the front surface;

a first chamber located in the housing adjacent the attachment inlet, the first chamber defining a first chamber outlet that is located between the attachment inlet and the attachment outlet;

wherein the rear surface of the sliding element is closer to the attachment inlet at times the sliding element is in the first position than at times the sliding element is in the second position;

wherein the front surface of the sliding element is closer to the attachment inlet at times the sliding element is in the first position than at times the sliding element is in the second position; and wherein at times the sliding element is in the first position, the sliding element is separated from the first chamber outlet by a first gap.

2. The attachment for a hair dryer of claim 1, wherein at times the sliding element is in the second position, the sliding element is separated from the first chamber outlet by a second gap, the second gap being larger than the first gap.

3. The attachment for a hair dryer of claim 1, wherein at times the sliding element is in the second position, the front surface of the sliding element is at or near the attachment outlet.

4. The attachment for a hair dryer of claim 1 further including an inner housing, the sliding element being located in the inner housing.

5. The attachment for a hair dryer of claim 4, wherein the inner housing includes a cross-sectional area that is smaller at the second end than the first end.

6. The attachment for a hair dryer of claim 5, wherein a slide lever is slidably coupled to at least one of the inner housing and housing, the slide lever being operable to move the sliding element between the first position and the second position.

7. The attachment for a hair dryer of claim 1, wherein the first chamber is located in the housing adjacent the attachment inlet, the first chamber defining a first chamber outlet that is located between the attachment inlet and the attachment outlet.

8. The attachment for a hair dryer of claim 7, wherein at times the sliding element is in the first position, the sliding element is separated from the first chamber outlet by a first gap.

9. An attachment for a hair dryer, comprising:

a housing that defines an attachment inlet at a first end and an attachment outlet at a second end;

a sliding element receivable within the housing and movable between a first position and a second position, the sliding element having a rear surface and a front surface and an opening that extends therethrough from the rear surface to the front surface;

wherein the rear surface of the sliding element is closer to the attachment inlet at times the sliding element is in the first position than at times the sliding element is in the second position;

wherein the front surface of the sliding element is closer to the attachment inlet at times the sliding element is in the first position than at times the sliding element is in the second position; and wherein at times the sliding element is in the second position, the front surface of the sliding element is at or near the attachment outlet.

10. An attachment for a hair dryer, comprising:

a housing that defines an attachment inlet at a first end and an attachment outlet at a second end;

a sliding element receivable within the housing and movable between a first position and a second position, the sliding element having a rear surface and a front surface and an opening that extends therethrough from the rear surface to the front surface;

an inner housing, the sliding element being located in the inner housing;

wherein the rear surface of the sliding element is closer to the attachment inlet at times the sliding element is in the first position than at times the sliding element is in the second position;

wherein the front surface of the sliding element is closer to the attachment inlet at times the sliding element is in the first position than at times the sliding element is in the second position; and wherein the inner housing includes a cross-sectional area that is smaller at the second end than the first end.

11. The attachment for a hair dryer of claim 1, further comprising a first chamber located in the housing adjacent the attachment inlet, the first chamber defining a first chamber outlet that is located between the attachment inlet and the attachment outlet.

12. The attachment for a hair dryer of claim 11, wherein at times the sliding element is in the first position, the sliding element is separated from the first chamber outlet by a first gap.

* * * * *